US006141994A

United States Patent [19]

Plath

[11] Patent Number: 6,141,994

[45] **Date of Patent: *Nov. 7, 2000**

[54] KNITTING MACHINE AND CONTROL JACK THEREFOR

[75] Inventor: Ernst-Dieter Plath, Albstadt, Germany

[73] Assignee: SIPRA Patententwicklungs- u. Beteiligungsgesellschaft mbH, Albstadt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/164,052

[22] Filed: Sep. 30, 1998

[30] Foreign Application Priority Data

Oct. 5, 1997 [DE] Germany ..... 197 43 814

[51] Int. Cl.[7] ..... D04B 35/02

[52] U.S. Cl. ..... 66/219

[58] Field of Search ..... 66/116, 123, 216, 66/218, 219, 221, 222

[56] References Cited

U.S. PATENT DOCUMENTS 4,905,484 3/1990 Schindler .
5,076,074 12/1991 Halamoda et al. ..... 66/123

FOREIGN PATENT DOCUMENTS 1 760 405 6/1971 Germany .
35 41 171 C2 10/1987 Germany .
37 12 673 C1 8/1988 Germany .
37 39 924 A1 2/1989 Germany .
40 07 253 A1 9/1991 Germany .
1 452 582 10/1976 United Kingdom .
1 477 890 6/1977 United Kingdom .
2 189 512 10/1987 United Kingdom .

*Primary Examiner*—Danny Worrell
*Attorney, Agent, or Firm*—Michael J. Striker

[57] ABSTRACT

A knitting machine comprises at least one knitting implement carrier (1) having tricks (10) and knitting implements (8) slidably mounted therein, a cam system for guiding the knitting implements (8) in pass or raise tracks (15, 16), control jacks (9) formed as two-armed levers associated with the knitting implements (8), which jacks have controllable raising butts (21) and armature surfaces and are mounted freely pivotable in tricks (10) of the carrier (1), springs (26) bearing on the trick bottoms for biasing the control jacks (9) and at least one selector station with a control magnet (25) and a presser cam system part (24) for so turning the control jacks (9) that their armature surfaces are applied to the control magnet (25) and are then selectively held or released from this. In accordance with the invention the control jacks (9) and the control magnet (25) are so designed and arranged relative to one another that the controllable raising butts (21) each assume a raise position when the control jacks (9) have their armature surfaces (31) lying on the control magnet (25) and each assume a pass position when the control jacks (9) with their armature surfaces (31) are released from the control magnet (25) under the action of the springs (26).

15 Claims, 6 Drawing Sheets

KNITTING MACHINE AND CONTROL JACK THEREFOR

BACKGROUND OF THE INVENTION

This invention relates to a knitting machine and a control jack for controlling the same.

In order to implement the so-called three-path technique, i.e. an arbitrary selection of all knitting needles for knit, tuck and miss at a knitting system, numerous pattern devices are already known. These consist essentially of cam system parts forming knit, tuck and miss tracks and mechanical, electronic or electromagnetic control means, by means of which the knitting implements are distributed to these tracks.

In most knitting machines which are already known, which are designed for a three-path technique, either a substantial increase in the system width and/or a comparatively expensive construction of the pattern devices or the associated needles or jack has to be accepted. Thus for example a knitting machine is known (DE 3 739 924 A1) in which the control jacks associated with the knitting needles firstly have to be distributed at a first selector station in accordance with a pattern to a miss track and to a cam system track leading to the tuck position and then in a second selector station be left in accordance with the pattern in the tuck track or diverted into a knit track. Against the advantage that knitting needles and control jacks well-tried in practice can be used, there is the disadvantage that the double selection involves substantially doubling the system width, which means a large loss in performance on account of the small number of systems in any case possible, e.g. 48 systems with a needle cylinder diameter of 30". This disadvantage can indeed be avoided by a likewise known circular knitting machine (DE 4 007 253 C2), which makes the three-path technique possible without substantial system widening compared with the usual two-path technique. However such a knitting machine requires the use of special knitting needles with at least two pivotable control butts each instead of the generally used latch or slide needles, which is undesirable for reasons of cost.

Similar problems have arisen in the attempts to make other known selector devices previously used only for the two-path technique usable for the three-path technique. This applies for example to known selector devices (DE 3 712 673 C1) in which control jacks in the form of single arm levers are associated with the knitting needles and serve simultaneously as control elements and needle push-jacks. These control jacks are biased radially outwards by springs fitted in their backs, into a raise position and have to be swung on to the control magnet, which lies radially inside the needle circle, against the spring force before reaching the selection station, by means of a special presser race, which acts on rocking butts of the control jacks, in order thereby to lower the controllable raising butts into the needle tricks, i.e., swing them out into the working range of the cam system races. If such a selector device is used to make a double selection station, in that for example a second, corresponding selector device is arranged where the needles reach the tuck position, a second presser cam system part must be associated with this second selector device, in order to swing the control jacks running in the tuck position away from the corresponding raise part and apply them to a second control magnet. This second presser cam system part does indeed not double the system width as in the first cited knitting machines, but has the result that in no case can 60, 64 or 72 system be fitted round the periphery of a circular knitting machine with a needle cylinder diameter of 30", which is desirable for patterning reasons. In still further known knitting machines of this kind (DE-AS 1 760 405), which are also provided with control jacks in the form of single arm levers, each having a controllable raising butt, there is indeed the advantage that these already assume a position on reaching the tuck position which makes the use of a presser cam system part for the second control magnet unnecessary. A disadvantage with this solution is however the fact that the control jacks either each have to be provided on both sides with a spring or when using only one spring disposed on the front side of the control jacks, an additional tensioning cam system part is needed for this, which results in a corresponding unfavourable system widening as does a presser cam system part for the control jacks.

Finally a knitting machine has already been made known (DE 3 541 171 C2), which includes at least one knitting implement carrier, which comprises tricks and knitting implements slidably mounted therein, a cam system for guiding the knitting implements in pass or raise tracks, wherein the cam system and the carrier can be moved relative to one another, control jacks having controllable raising butts associated with the knitting implements for their selective transfer into the pass or raise track, which jacks are mounted slidably in the tricks of the carrier, are freely pivotable about bearing points which can abut the trick bottoms and have first and second lever arms to opposite sides of the bearing points, where the first lever arms are provided with armature surfaces and the second lever arms with rocking butts. Springs bearing on the trick bottoms are provided for biasing the second lever arms. At least one selector station with a control magnet adapted to cooperate with the armature surfaces and a presser cam system part serves for so swinging the control jacks that the armature surfaces are applied to the control magnet and are then selectively held or released thereby. The control magnet is located in this case on the front side of the control jacks. The pattern device developed as a whole for the particular case of a flat knitting machine is of comparatively complex construction. The control jacks serve only as control elements but not as needle push-jacks. Only a pre-selection is effected by them and the control magnet while the transfer of the needles into the tuck or knit position is effected with other means and at a location lying after the double selector station. The double selection is here effected in that all control jacks are applied to the control magnet at the first selector station by means of a presser cam, in order to select needles which are to be raised to a knitting position by pattern-based control of the control magnet, while the other needles are held deflected by an associated retaining pole against the forces of the springs, until they reach the second selector station, where a selection is made between the needles which are to be raised into a tuck position or which shall remain in a non-knitting position. The controllable raising butts in each case effect only a comparatively short lift of the control jacks, while the actual separation of the control jacks selected to knit, tuck and miss is effected in each case by means of an additionally present, second, non-controllable raising butt, which is formed on the lever arm of each control jack with the armature surface and always assumes a raise position regardless of the position of the controllable raising butt.

Such a selector device accordingly does not only involve a substantial increase in the system width and in the expense of construction but also does not operate with sufficient reliability, at least when used on circular knitting machines. Since the control jacks are held tight between the two selector stations solely by the holding magnet, it is not possible reliably to avoid the control jacks dropping uncontrollably off the hold magnet because of the action of the springs, therefore causing pattern faults, when vibration unavoidably occurs in rapidly running circular knitting machines.

SUMMARY OF THE INVENTION

It is, therefore, an object of this invention to design the knitting machine mentioned above such that its selector device is particularly suitable for fast running knitting machines.

A further object of this invention is to design the selector device and the control jacks such that they do not, if the three-path technique is implemented, substantially increase the system width compared with the ordinary two-path technique.

Yet another object is to provide a control jack suitable for such a knitting machine.

These and other objects of this invention are solved in that the control jacks and the control magnet are so designed and arranged relative to one another that the controllable raising butts each assume a raise position when the control jacks have their armature surfaces lying on the control magnet and each assume a pass position when the control jacks with the armature surfaces are released from the control magnet under the action of the springs.

The invention rests on the surprising recognition that, in order to solve the described problems, it is essentially only necessary to invert the selection principle underlying the control jacks of the type defined, i.e. so to provide the control that the control jacks assume their raise position and not their pass position when they lie on the magnet. This is easy to implement in that the controllable raising butt is provided on the lever arm with the armature surface, instead of on the lever arm with the rocking butt and the second, non-controllable raising butt is dispensed with. It is moreover possible through this to use the control jacks in a manner known per se simultaneously as control elements and as needle push-jacks. The desired three-path technique can therefore be realised with means which are constructionally very simple, operate reliably even at high working speeds and can be made with a small system width.

Further advantageous features of the invention appear from the dependent claims.

BRIEF DESCRIPTION OF THE DRAWINGS

The invention will now be explained in more detail in conjunction with the accompanying drawings of an embodiment, in which.

DESCRIPTION OF PREFERRED EMBODIMENTS

Figure 1:
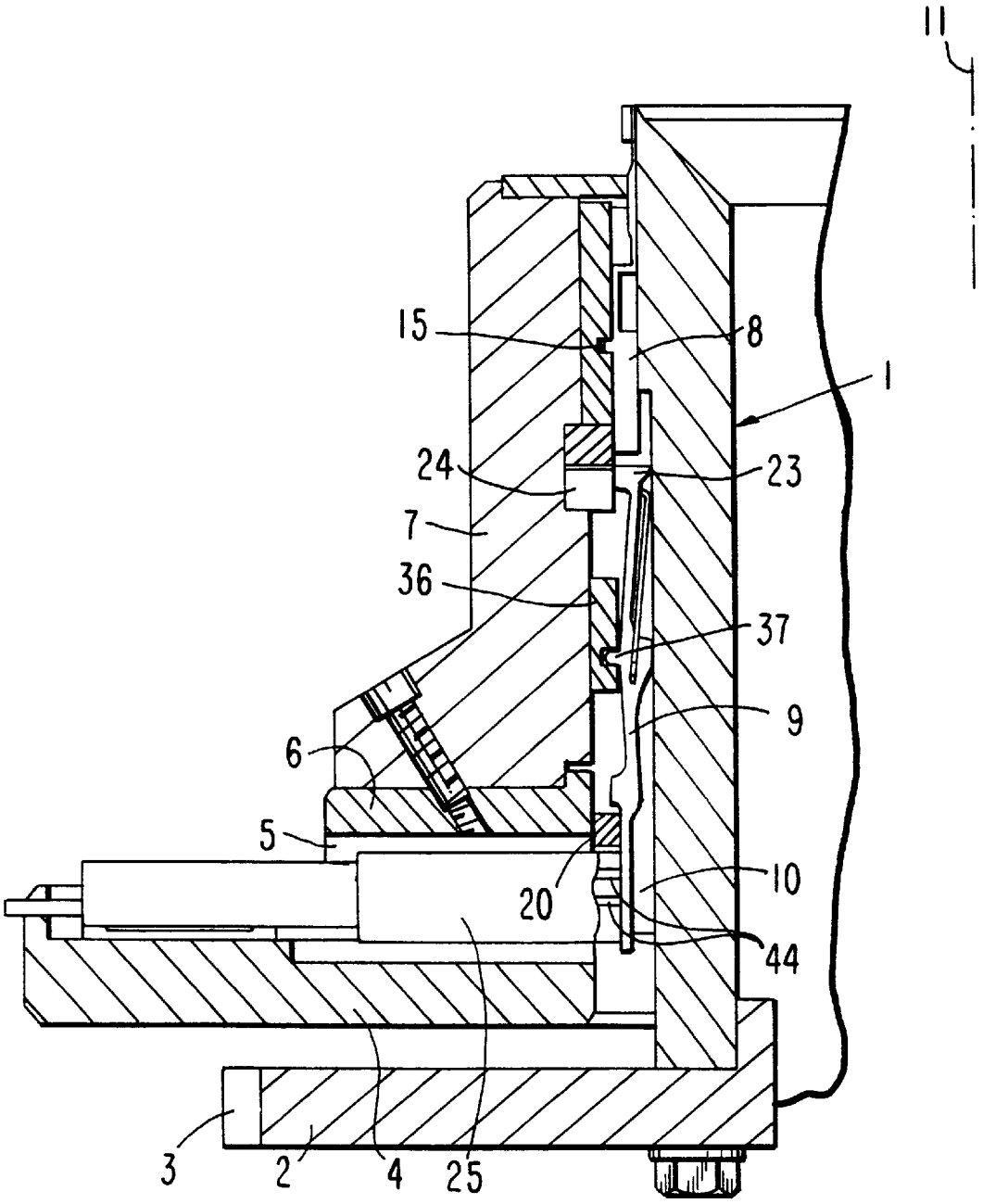
FIG. 1 is a highly schematic radial, vertical section through a circular knitting machine in the region of a selector device.

FIG. 1 shows at least one knitting implement carrier of a circular knitting machine in the form of a needle cylinder 1, which is fixed on a support ring 2 mounted rotatably in a machine frame. The support ring 2 is provided with an outer ring of drive gear teeth 3, which are coupled through transmission gears or the like, not shown, to a drive motor. A support ring 6 is fitted by means of webs 5 on a stationary cam system plate 4 mounted in the machine frame and cam system carriers 7 associated with the individual knitting systems are fixed on the support ring and carry on their insides cam system parts which act on the butts of knitting needles 8 or other knitting implements and control jacks 9 associated therewith, where the needles 8 and control jacks 9 are arranged in tricks 10 of the needle cylinder 1 formed by webs or the like. The tricks 10 run parallel to the axis of rotation 11 of the needle cylinder 1. The needles 8 are mounted to slide parallel to the axis of rotation 11 in the tricks 10. The control jacks 9 are arranged in the tricks 10 underneath the needles 8 and are mounted not only to slide parallel to the axis of rotation 11 but also to pivot radially.

Figure 2:
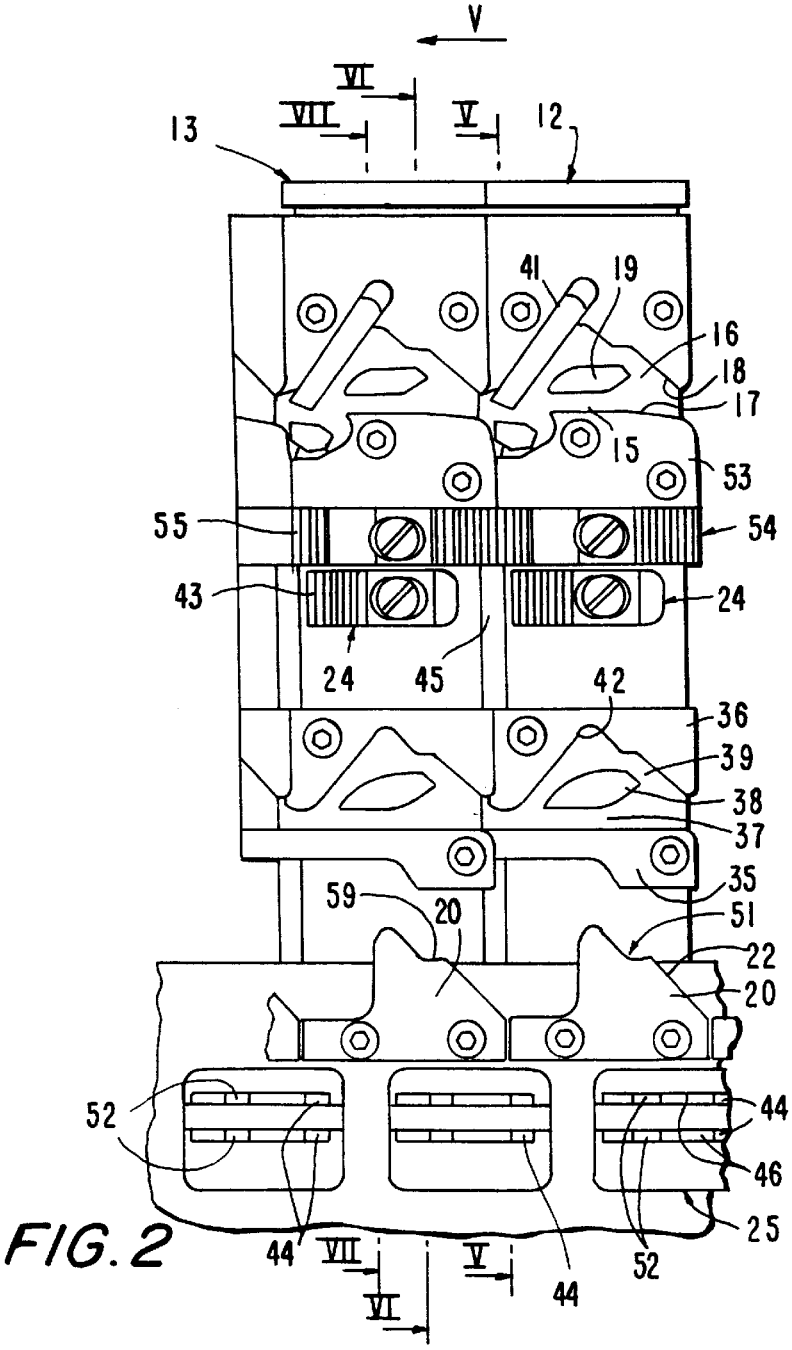
FIG. 2 is a schematic front view of two adjacent cam systems, seen from the side of the needle cylinder of the circular knitting machine according to FIG. 1.
Figure 3:
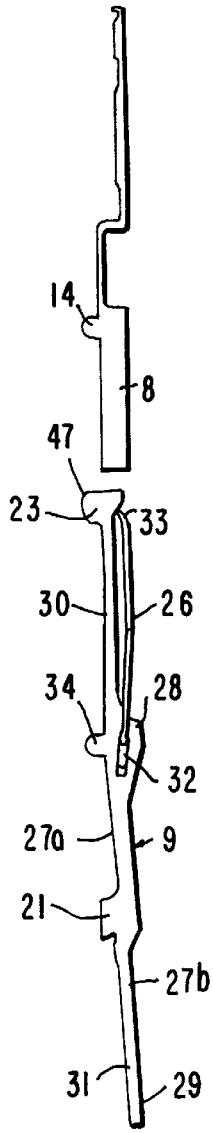
FIG. 3 shows a knitting needle and a control jack in accordance with the invention associated therewith.
Figure 4:
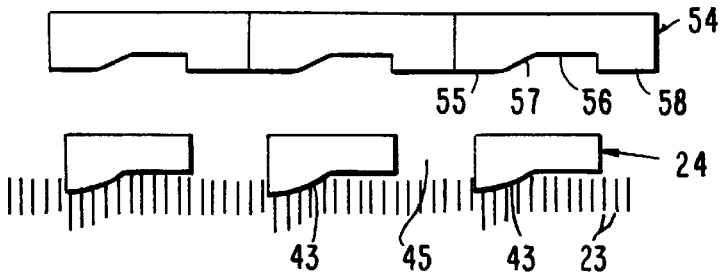
FIG. 4 is a plan view of adjacent presser cam systems parts of the cam systems according to FIG. 2.

As FIGS. 2 to 4 in particular show, cam systems 12 and 13 are associated with the individual knitting systems of the circular knitting machine and can be of the same or different forms and of which only two are shown in FIG. 2 by way of example. In the embodiment the cam system 12 comprises a section in an upper region by means of which butts 14 of the needles 8 can be guided selectively into a pass or miss track 15 or be raised along a raise track 16, in order for example to receive a yarn from a yarn feeder, not shown. The cam system 12 is provided to this end with lower and upper edges 17, 18 and a guard cam system part 19 lying therebetween.

Below the tracks 15, 16 the cam system 12 comprises a raise part 20 for controllable raising butts 21 of the control jacks 9. The selection between whether a needle 8 is to remain with its butt 14 in the pass track 15 or to go into the raise track 16 is effected in that the control jacks 9 is so pivoted in the tricks 10 that their raising butts 21 either stand out radially from the tricks 10 of the needle cylinder 1 (FIG. 1) and are thereby engaged by a raise edge 22 of the raise part 20 and are lifted (raise position of the control jacks 9), or are sunk radially into the tricks 10 (FIG. 5) and then pass the raise part 20 on its front side, without being lifted (pass position of the control jacks 9). In order to prepare the selection the control jacks 9 also each have a rocking butt 23 and the cam system 12 has a first presser cam system part 24 shown in FIG. 4 in particular, which pivots the control jacks 9 in a first preselected position before their entry into a selector station, while a control magnet 25 serves to implement the selection. This magnet is arranged in the region of a selector station and serves either to hold the control jacks 9 passing thereby or to release them again, in accordance with the pattern, in which latter case they are swung away from the control magnet 25 under the action of springs 26.

Knitting machines of this kind are generally known and therefore do not need to be explained in more detail to the man skilled in the art (e.g. DE 3 541 171 C2 and DE 3 712 673 C1, whose contents are made part of the subject matter of the present disclosure in order to avoid repetition).

The control jack 9 in accordance with the invention consists essentially of an elongated shank which has a front side 27*a*, a rear side 27*b* and a bearing point 28 in a middle section, which consists in essence of a bearing surface located on the rear side, by means of which the control jack 9 is so supported on the bottom of the trick 10, when it is arranged in the mounted state in the trick 10 (FIG. 1), that it can be pivoted about this bearing surface about an axis perpendicular to the axis of rotation 11. The bearing point 28 is accordingly formed to particular advantage as a circular arc on its rear side. Extending from the bearing point 28 are a first lever arm 29 projecting downwardly in the drawing and a second lever arm 30 projecting upwardly, so that the control jack 9 is formed as a two-armed lever. The first lever arm 29 has an armature surface 31 on its front side 26, which consists for example simply of a suitable section of the front face of the lever arm 29, and the controllable raising butt 21 which also projects to the front side and which is advantageously arranged between the armature surface 31 and the bearing point 28. On the other hand the second lever arm 30 is provided with the rocking butt 23, which preferably projects outwards beyond the front side 27*a* of the control jack 9. The spring 26 is moreover so arranged on the rear side of the second lever arm 30 that, when the control jack 9 is fitted in the corresponding trick 10 of the needle cylinder 1 (FIG. 1), it tends to swing the second lever arm 30 and thus the rocking butt 23 radially out of the trick 10 and at the same time to swing the controllable raising butt 21 radially inwards into the trick 10. The spring 26 can consist of flexible section formed in one piece with the control jack 9 or, as the drawings show, be made from a spring wire element, which has one end fitted into a slot-like recess 32 preferably near to the bearing point 28 and preferably firmly anchored therein. The spring 26 preferably has a curved section which forms a support surface 33 with its apex projecting to the rear side, with which the spring 26 can bear on the bottom of the associated trick 10.

Finally, it can be seen from the drawings that the control jack 9 is provided in the region of the bearing point 28 and the recess 32, but on its front side 27*a,* with an additional clearing butt 34, preferably of circular arcuate form. The cam system 12 has additional cam systems parts 35 and 36 in a middle region corresponding to the position of the clearing butt 34 and thus disposed between the cam system part 20 and the presser part 24, by means of which the clearing butts 34 of the control jacks 9 can be guided into a pass track 37 or a raise track 39 separated therefrom by a guard cam system part 38, where the tracks 37, 39 correspond essentially to the tracks 15, 16 (FIG. 2). The height of the clearing butt 34 is preferably smaller than the distance between the bearing point 28 and the front side 27*a*.

The cam system 13 and the cam systems associated with the other knitting systems, not shown in FIG. 2, are formed correspondingly in the embodiment.

The mode of operation of the circular knitting machine explained above with reference to FIGS. 1 to 4 is essentially as follows:

With the needle cylinder 1 rotating and the cam system stationary the knitting needles 8 and control jacks 9 move in the direction of an arrow v in FIG. 2. The butts 14 of the needles 8 raised ahead in the direction of movement of the cam system 12 as well as the clearing butts 34 of the associated control jacks 9 are located on entry into the cam system 12 at the level of the pass tracks 15 and 37 respectively, since they were lowered in the proceeding cam system by means of customary clearing parts 41 and clearing edges 42 of the cam system parts 36 respectively. The butts 14, 34 of needles 8 and control jacks 9 not raised in the preceding cam system are likewise at the level of the pass tracks 15 and 37 respectively. Regardless of this, the rocking butts 23 of all control jacks 9 come at the end region of the preceding cam system into the range of action of the presser cam system parts 24, which have radially inwardly rising presser surfaces 43 (FIG. 4) and therefore swing all rocking butts 23 radially inwards, against the force of the springs 26, into the associated tricks 10 of the needle cylinder. Accordingly the control jacks 9 mounted to pivot freely in the tricks 10 are so turned about the bearing points 28 into their raise positions that their armature surfaces 31 bear one after the other on the control magnet 25 and are released or retained by its control pole 44 (FIG. 2) in accordance with the pattern.

Figure 5:
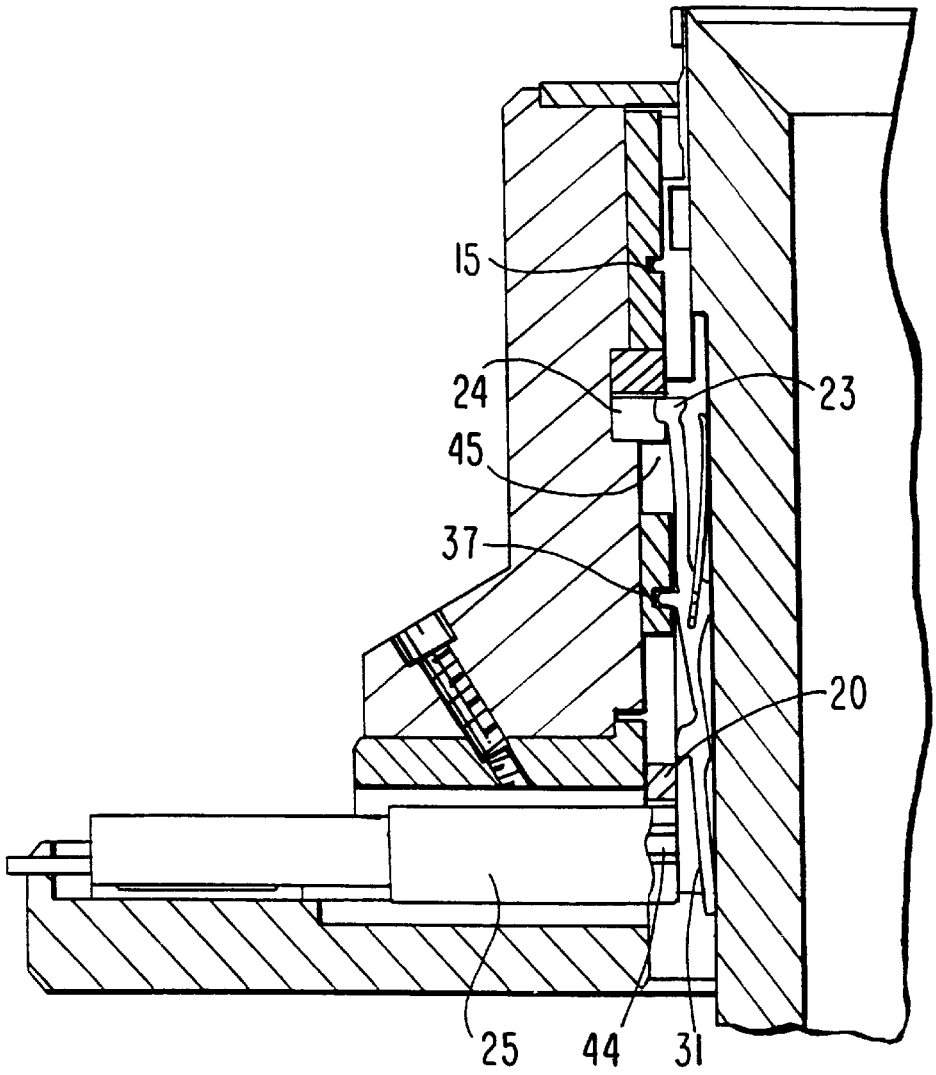
FIGS. 5 to 7 show radial vertical sections schematically, similar to FIG. 1, along the lines V—V to VII—VII of FIG. 2.
Figure 6:
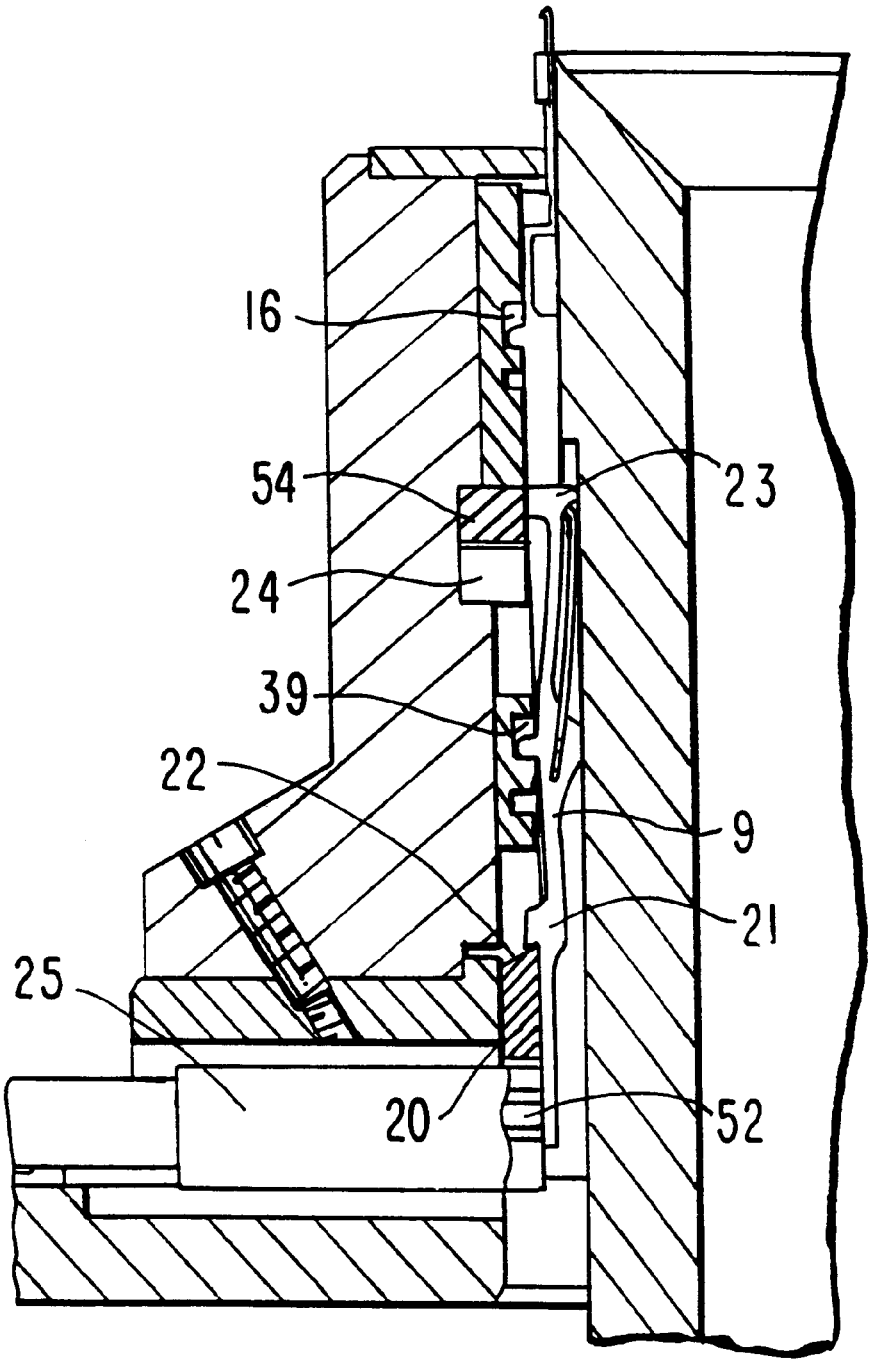
Figure 7:
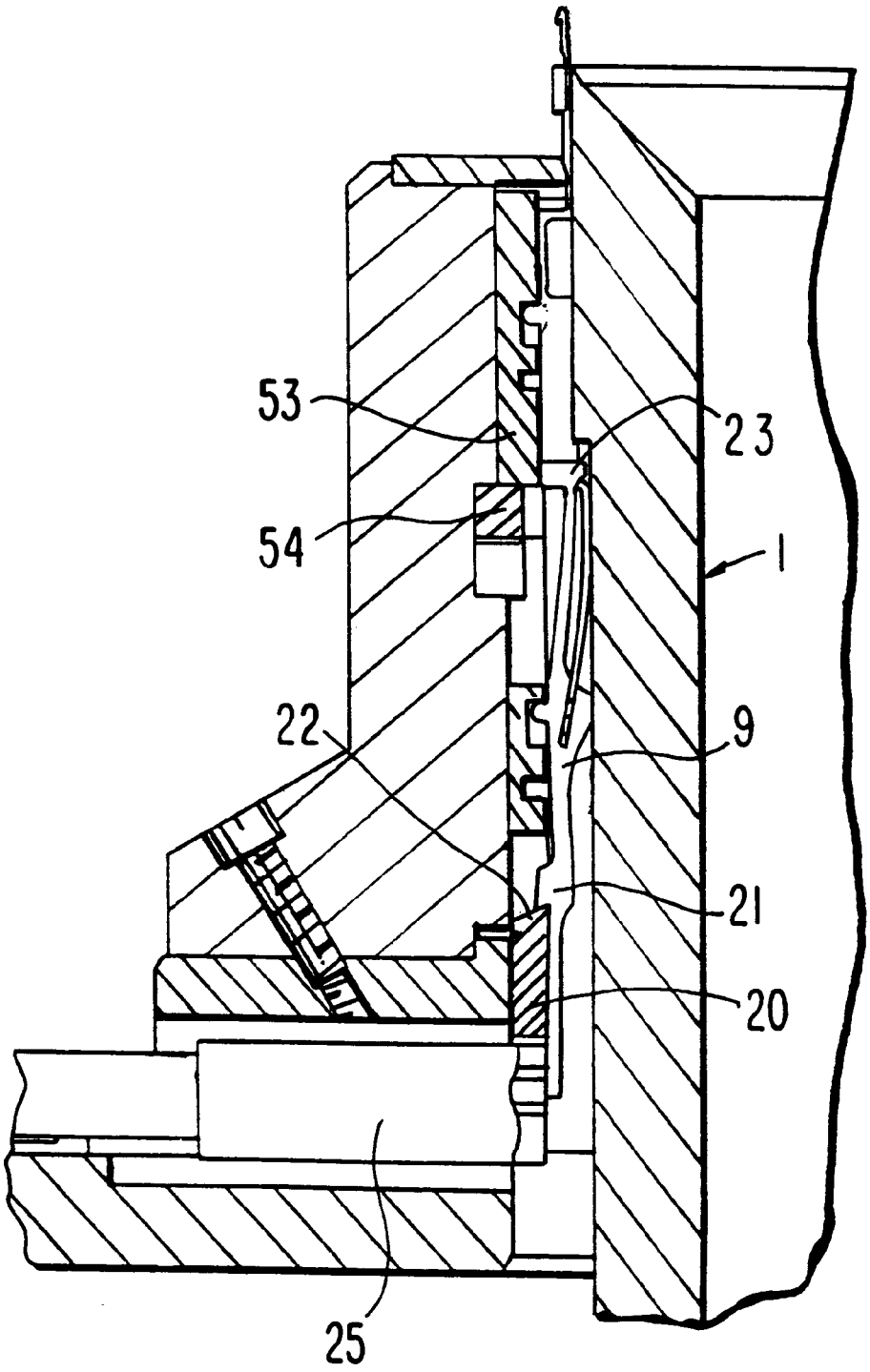

The control jacks 9 pertaining to the released armature surfaces 31 (FIG. 5) are turned about the bearing points 28 into the pass positions by the springs 26 in further travel, until their operating butts 21 are sunk fully into the tricks 10 and therefore cannot be engaged by the raise edge 22 of the cam systems parts 20. This can be seen above all from FIG. 5 and is facilitated in that the presser can systems parts 24 have a gap 45 (FIG. 4) or recess in this region, which allows the rocking butts 23 to emerge from the tricks 10. The section lines V—V to VII—VII for FIGS. 5 to 7 are shown in the region of the cam system 13 in FIG. 2 for greater clarity, instead of in the region of the cam system 12, to which the present description relates. The corresponding operating butts 21 pass by the front side of the cam system part 20 during the further movement, without being raised thereby, so that the clearing butts 34 and the butts 14 of the needles 8 go into the corresponding pass tracks 37 and 15 respectively.

The armature surfaces 31 not released by the control poles 44 are in contrast also retained during further passage by holding poles 46 (FIG. 2) arranged after the control poles 44, so that the control jacks 9 remain in their raise positions, as is shown in the section of FIG. 1 also shown along the section line V—V, and then in further passage run with their raising butts 21 on the raise edge 22 of the cam system part 20, as FIG. 6 shows. These control jacks 9 are therefore raised during the further passage along the raise edge 22. Accordingly upper acting edges 47 (FIG. 3) of the rocking butts 23 bear on the bottom edges of the associated needles 8 or other knitting implements (FIG. 6), so that these are correspondingly raised. Both the clearing butts 34 and the butts 14 of the needles 8 thus firstly enter the corresponding raise tracks 39 and 16 respectively, from which they are cleared again into the pass tracks 37 and 15 respectively by the clearing edges 42 and 41 respectively after completion of the raising.

A particular advantage of the described control jacks 9 or selector devices lies in that the controllable raising butts 21 are so arranged that the control jacks 9 assume their respective raise positions when they lie on the control magnet 25. By the expression "controllable" raising butts is to understood that butts are concerned which are not in the raise position permanently and independent of the pivoted state of the control jacks 9, but assume either the raise position or the pass position, in which they are not engaged by the raise edge 21, in accordance with the pattern. On account of this arrangement of the raising butts 21, which lie like the armature surfaces 31 and the control magnet 25 on the front sides of the control jacks 9, it is possible to provide a second selector station within the cam system 12 or 13, without the system width or the width of the cam system 12, 13 being substantially increased.

Such a second selector station is shown in the embodiment on the section line VI—VI and in FIG. 6. It is located in a central part of the raise edge 22 at a station 51 and is so arranged that the raising butts 21 running on the raise edge 22 are subjected to a second selection by means of a second control pole 52 of the control magnet 25 present there. This is possible without second presser race being needed corresponding to the presser race 24 and increasing the system width, because armature surfaces 31 present on the same lever arm 29 as the raising butts 21 already assume their pivoted position required for bearing against the control pole 52 on reaching the station 51. The raising butts 21 are therefore, in accordance with the pattern, either left on the raise edge 22 and then raised to their highest position, as FIG. 7 shows, or are knocked off these, as is already known in a similar way for needles with rocking butts and selector devices of different construction (DE 4 007 253 A1). The control jacks 9 are accordingly suitable above all for rapidly running circular knitting machines with a plurality of e.g. 60, 64 or 72 knitting systems for implementing the so-called three-path technique with selection of miss, tuck and knit, although the described control jack 9 is naturally also suitable for all other knitting machines with suitable selector devices. The selection of "knit" corresponds to the full raise height according to FIG. 7 and the selection of "tuck" to the raise height attained at the station 51 according to FIG. 6 and the then following clearing of the control jacks 9.

As FIGS. 1, 2 and 5 to 7 in particular show, the cam system parts 35, 36, 38 are preferably parts of a body made in one piece, in which the tracks 37, 39 are machined. This body is formed at least in the region of the first selector station (control pole 44) as a radially acting presser cam system part, on which the clearing butts 34 arranged in the region of the centre of gravity (bearing point 28) bear from the inside. The presser cam system part is preferably arranged as such a radial distance from the bottoms of the tricks 10 that the control jacks 9 are guided between it and the trick bottom with close play and therefore cannot undergo any uncontrolled radial movements. Moreover the front sides of the clearing butts 34 and the rear sides of the bearing points 28 can be of circular arc form, in order thus to ensure easy ability to pivot of the control jacks 9.

In order that the control jacks 9 retained by the control magnet 25 do not experience undesirable radial rebounds when they impinge during the further movement on the raise edge 22 and are then raised thereby, it is possible to shape the lower sides of the raising butts 21 and correspondingly the upper side of the raise edge 22 with a dovetail form, i.e. to provide them with wedge-shaped, inclined surfaces, which engage in hook fashion with one another during raising of the control jacks 9 (FIG. 7) and form an interlocking connection in the radial direction. In this case the control jacks 9 are preferably held in a slightly raised position during the selection process (FIG. 1), so that they can swing into the pass position without impediment with corresponding control of the control magnet 25. The raising of the control jacks 9 can be effected with aid of a cam race acting on the clearing butt 34.

In order that the control jacks 9 do not have to be pulled for reasons of reliability away from the control magnet 25 and held during the whole raising operation, it is further provided to fit a further presser cam system part 54 between the presser cam system part 24 and a cam system part 53 comprising the upper edge 17, with its front contour apparent in FIG. 4 in particular, in which the two presser cam system parts 24, 54, are shown behind one another instead of above one another in accordance with FIG. 2. According to this the presser cam system part 54 lying closely above the presser cam system part 24 includes a front presser section 55 substantially parallel to the peripheral surface of the needle cylinder 1, which directly adjoins the end of the presser surface 43 of the presser cam system part 24 in the direction of the arrow v and lies in the same radial plane as this. The result of this is that the presser cam system part 54 covers from the outside the rocking butts 23 turned radially inwards, as soon as the raising butts 21 of the control jacks 9 have run on to the raise edge 22 and have been listed somewhat thereby (FIGS. 1 and 6). An unwanted radially outwards turning back of the upper lever arms 30 under the action of the springs 26 is hereby avoided even when the retaining poles 46 (FIG. 2) of the control magnet 25 are not fully effective along the raise edge 22 and/or the lower arms 29 tend to swing radially inwards from the cam system part 20 because of shocks, vibration or the like.

In order to achieve the same effect also at the second selector station (51 in FIG. 2) the cam system part 53 is arranged closely above the presser cam system part 54 and is so designed in accordance with FIGS. 2 and 7 that its front surface represents a continuation of the presser section 55 in the direction of the arrow v. Accordingly the cam system part 53 covers from the outside the rocking butts 23 swung radially inwards at 51, as soon as the raising butts 21 of the control jacks 9 run on to the section of the raise edge 22 present following the station 51 and have been lifted somewhat thereby, as FIG. 7 in particular shows.

In accordance with FIG. 4 the presser cam system part 54 is provided in that region in which it overlaps the presser cam system part 24 with a recess 56 and radially inwardly rising surface 57 connecting the recess with the presser section 55 and thus with a contour corresponding substantially to one of the presser surface 43. In this way it is ensured that the presser cam system part 54 does not impede the free turning of the control jacks 9 or the rocking butts 23, if the control jacks 9 should be released at the station 51 by an electric pulse fed to the second control pole 52.

Finally FIG. 4 shows that the presser cam system parts 54 have a radially inwardly rising presser surface 58 at their in-feed sides. This has a very shallow inclination of a few degrees only in contrast to the presser surface 43 of the presser cam system part 24 and serves the purpose to lower rocking butts 23 advanced with some play by the presser section 55 somewhat further into the tricks 10, in order the apply the armature surfaces 31 firmly to the control pole 52 in the region of the station 51. Moreover the presser cam system parts 54 can so designed in accordance with FIG. 4 that they can be arranged in abutment in the peripheral direction of the needle cylinder 1.

Figure 8:
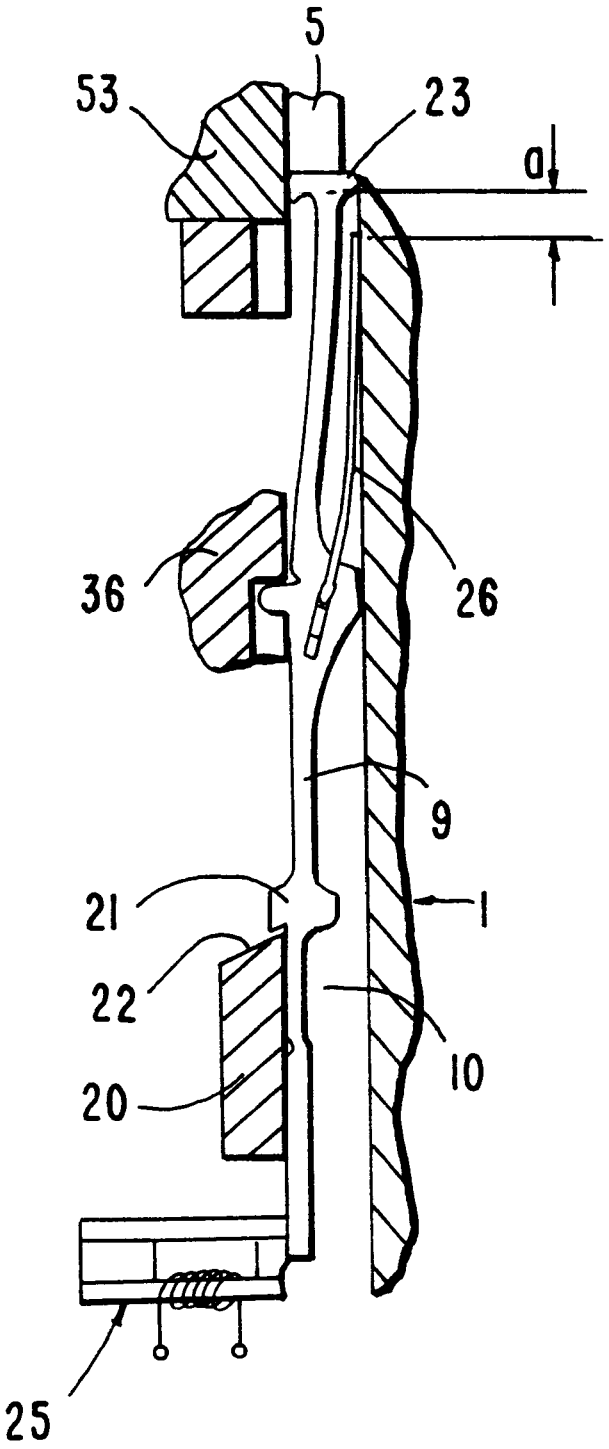
FIG. 8 is a schematic partial vertical section corresponding to FIG. 7 with a preferred detail of the invention.

According to a particularly preferred embodiment it is finally provided so to design the springs 26 and arrange them on the control jacks 9 that the direction of force of the springs 26 reverses in the region of the raise edge 22. The arrangement is so designed for this that a distance a measured in each case parallel to the axis of rotation 11 of the needle cylinder 1 is provided between the rocking butts 23 and the support surfaces 33 and the support surfaces 33 are arranged below the rocking butts 23, i.e. at locations between the rocking butts 23 and the bearing points 28. If the presser cam system part 54 or the cam system part 53 acts on the control jacks 9 against the force of the springs 26 in this case, a turning moment clockwise in FIG. 8 results, which is opposed to the turning moment normally developed by the springs 26, acting anticlockwise, and bringing the raising butts 21 reliably out of positions in which they do not bear fully on the raise edge 22 into firm seating on the raise edge 22 or holds them securely in this (FIGS. 6, 7).

The substantial advantage arising from the described inversion of the action of the springs 26 is that the cam system parts 53, 54 do not have to bear on the rocking butt 23 with tight play. Even if they were to have a certain spacing from the fully swung back rocking butts 23, the resulting turning moment would always tend to advance the control jacks 9 clockwise in FIGS. 5 to 7 and therefore closer to the cam system part 20.

The invention is not limited to the described embodiment, which can be modified in numerous ways. This applies in particular to the action of the control jacks 9 on the knitting needles 8 shown in the drawings, instead of which other knitting implements, e.g. additional needle lifters, plush hooks or the like could be provided. Moreover it would be possible to raise the control jacks 9 somewhat more than corresponds to the inclination of the raise edge 22 by means of the cam system part 36 and the clearing butts 34 where the second selector station 51 is, in order to lift the raising butts 21 from this edge, which improves the ability of the control jacks 9 to turn easily. At the same time it can be provided that the needles 8 are raised somewhat more by means of their butts 14 and the guard cam system part 19 than the control jacks 9. A free space (play) thus arises between the upper edges of the control jacks 9 and the lower edges of the needles 8, so that the control jacks 9 are practically freely pivotable in the station 51 also. Analogous means for relieving the raising butts 21 could consist in that the raise edge 22 is provided with a recess 59 in the region of the station 51, as is indicated for the left cam system part 20 in FIG. 2. Furthermore the described control jacks 9 can be used instead of in circular knitting machines with rotating needle cylinders also in circular knitting machines with rotating cam systems, in circular knitting machines with a second knitting implement carrier in the form of a rib dial or in flat knitting machines, as well as for purposes other than selection between miss, tuck and knit, especially for example for the selection of needles, which are for example to brought into a transfer position. Finally it will be understood that the individual features can be used also in combinations other than those illustrated and described.

It will be understood that each of the elements described above, or two ore more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A knitting machine comprising: at least one knitting implement carrier (1) having tricks (10) and knitting implements (8) slidably mounted in said tricks; a cam system having pass and raise tracks (15, 16) for guiding said knitting implements (8), wherein said cam system and said carrier (1) are movable relative to one another; control jacks (9) associated with said knitting implements (8) for selectively transferring said knitting implements (8) into said pass or raise tracks (15, 16), said jacks having bearing points (28), being mounted slidably in said tricks (10) of said carrier (1), being freely pivotable on bottoms of said tricks by means of said bearing points (28) and each having a first lower and a second upper lever arm (29, 30) to opposite sides of said bearing points, wherein said first lower lever arms (29) are provided with armature surfaces (31) and controllable raising butts (21) and wherein said second upper lever arms (30) are provided with rocking butts (23); springs (26) bearing on said trick bottoms for biasing said second lever arms (30); and at least one selector station having a control magnet (25) for cooperation with said armature surfaces (31) and a presser cam system part (24) for acting on said rocking butts for so swinging said control jacks (9) that said armature surfaces (31) are applied to the control magnet (25) and are then selectively held or released thereby; wherein said cam system has a raise portion (20) for cooperation with said raising butts and wherein said presser cam system part (24) acts onto said rocking butts such that said controllable raising butts (21) each assume a position for being raised by said raise portion when said control jacks (9) have their armature surfaces (31) lying on the control magnet (25) and each assume a pass portion for not being raised by said raise portion when said control jacks with the armature surfaces (31) are released from the control magnet (25) under the action of the springs (26).

2. A knitting machine according to claim 1, wherein said raising butts (21) are provided between said armature surfaces (31) and said bearing points (28) and wherein said control magnet (25) is arranged below said raise portion (20).

3. A knitting machine according to claim 1, wherein a means is provided for securing the raise position of said control jacks (9) pivoted with their controllable raising butts (21) on a raise edge (22).

4. A knitting machine according to claim 3, wherein said means is a cam system part (53, 54) cooperating with the rocking butts (23).

5. A knitting machine according to claim 3, wherein said means consists of a dovetail shaped formation of the controllable raising butts (21) and the raise edge (22).

6. A knitting machine according to claim 3, wherein said means include springs (26) so designed that their force action is reversed during the guiding of the control jacks (9) on the raise edge (22) and the control jacks (9) are held in abutment with the raise edge (22).

7. A knitting machine according to claim 6, wherein said springs (26) are arranged on the rear sides **(27*b*) of the second lever arms (30) and have abutment points (33) for abutment with the trick bottoms, which lie between the rocking butts (23) and the bearing points (28) of the control jacks (9), and in that a cam system part (53, 54) acting on the rocking butts (23) is associated with the raise edge (22)**.

8. A knitting machine according to claim 1, wherein said selector station is formed as a double selector station and includes a second control pole (52) arranged after, in the direction of the raise edge (22), a first control pole (44) of the control magnet (25).

9. A knitting machine according to claim 8, wherein said raise edge (22) has two sections lying one after the other and the second control pole (52) is arranged between the two sections.

10. A knitting machine according to claim 9, wherein said section lying in front in the direction of the raise movement ends at a tuck level and the section lying behind ends at a knit level.

11. A knitting machine according to claim 9, wherein said second control pole (52) is so arranged that the armature surfaces (31) of said control jacks (9) guided on to the raise edge (22) bear thereon at the end of said first section.

12. A knitting machine according to claim 11, wherein said raise edge (22) is provided where the second control pole (52) is disposed with a means for relieving the controllable raising butts (21).

13. A knitting machine according to claim 12, wherein said means includes a recess (59) in the raise edge (22).

14. A knitting machine according to claim 1, wherein said control jack (9) has a clearing butt (34) in the region of the bearing point (28).

15. A knitting machine according to claim 14, wherein said means includes a cam system part (36) associated with the clearing butt (34).

* * * * *